US010041510B2

(12) United States Patent
Archer

(10) Patent No.: US 10,041,510 B2
(45) Date of Patent: Aug. 7, 2018

(54) HYDRAULIC ACTUATOR

(71) Applicant: Andrew J. Archer, St. Paul, MN (US)

(72) Inventor: Andrew J. Archer, St. Paul, MN (US)

( * ) Notice: Subject to any disclaimer, the term of this patent is extended or adjusted under 35 U.S.C. 154(b) by 219 days.

(21) Appl. No.: 14/830,582

(22) Filed: Aug. 19, 2015

(65) Prior Publication Data

US 2016/0053780 A1 Feb. 25, 2016

Related U.S. Application Data

(60) Provisional application No. 62/039,355, filed on Aug. 19, 2014.

(51) Int. Cl.
*F15B 15/06* (2006.01)

(52) U.S. Cl.
CPC ..... *F15B 15/06* (2013.01); *F15B 15/068* (2013.01)

(58) Field of Classification Search
CPC ..... F15B 15/06; F15B 15/14; F15B 15/16; F15B 15/17; F01B 3/04; F01B 3/08; F16H 3/54
USPC ..... 92/32, 33
See application file for complete search history.

(56) References Cited

U.S. PATENT DOCUMENTS 4,313,367 A * 2/1982 Weyer ..... F16C 17/10 92/33
4,867,000 A * 9/1989 Lentz ..... F15B 15/02 254/93 A
5,447,095 A * 9/1995 Weyer ..... F15B 15/068 29/888.06
6,212,889 B1 * 4/2001 Martin ..... F15B 15/068 60/602
9,464,643 B2 * 10/2016 Shu ..... F15B 15/068
2012/0079901 A1 4/2012 Shu
2012/0263616 A1 * 10/2012 Rosenboom ..... F04B 9/02 418/81

OTHER PUBLICATIONS

WIPO, U.S. International Search Authority, International Search Report and Written Opinion dated Nov. 12, 2015 in International Patent Application No. PCT/US2015/045948, 10 pages.

* cited by examiner

*Primary Examiner* — Thomas E Lazo
(74) *Attorney, Agent, or Firm* — Inskeep IP Group, Inc.

(57) ABSTRACT

A hydraulic actuator employing, in part, a short piston stroke distance and a planet gear amplification to achieve a relatively rapid actuation through a relatively low power input.

20 Claims, 3 Drawing Sheets

HYDRAULIC ACTUATOR

RELATED APPLICATIONS

This application claims priority to U.S. Provisional Application Ser. No. 62/039,355 filed Aug. 19, 2014, entitled Hydraulic Actuator, which is hereby incorporated by reference in its entirety.

FIELD OF THE INVENTION

The present invention relates to actuators and, more particularly, to hydraulic actuators capable of a relatively rapid actuation at a relatively low power input.

BACKGROUND OF THE INVENTION

Hydraulic actuators are employed in a broad range of fields in order to effect a broad range of desired motion, work, or actuations. However, known actuators are encumbered by the competing objectives of providing relatively fast, robust actuation while not requiring a high power input. Typically, actuators capable of providing a relatively fast actuation also require a relatively high power input. Conversely, actuators that require a relatively low power input are only capable of a relatively slow actuation.

What is needed in the art is an actuator that requires relatively low power input in order to provide relatively fast actuation speeds.

OBJECTS AND SUMMARY OF THE INVENTION

The present invention provides an actuator that requires relatively low power input in order to provide relatively fast actuation speeds. These objectives are, in part, achieved by providing an actuator comprising an inner cylindrical gear positioned within an interior of a tubular piston and in direct rotatable engagement with the piston; an outer annular gear positioned around a portion of an exterior of the piston and in direct rotatable engagement with the piston; and a plurality of planet gears in rotational communication with the piston through the outer annular ring and through the inner cylindrical gear and in direct rotatable engagement with an inner tubular gear.

These objectives are further achieved by providing an actuator comprising a hub through which a tubular piston is positioned; a primary shaft positioned through an interior of the tubular piston; a secondary shaft positioned over a portion of the primary shaft; and a plurality of planet gears positioned around a portion of an exterior of the secondary shaft.

These objectives are further achieved by providing a method for hydraulic actuation comprising the step of: displacing a tubular piston axially along a primary axis and circumferentially around the primary axis; rotating a plurality of planet gears around a plurality of secondary axes that are substantially parallel to the primary axis based upon said displacing; and providing a rotation output based upon said rotating.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
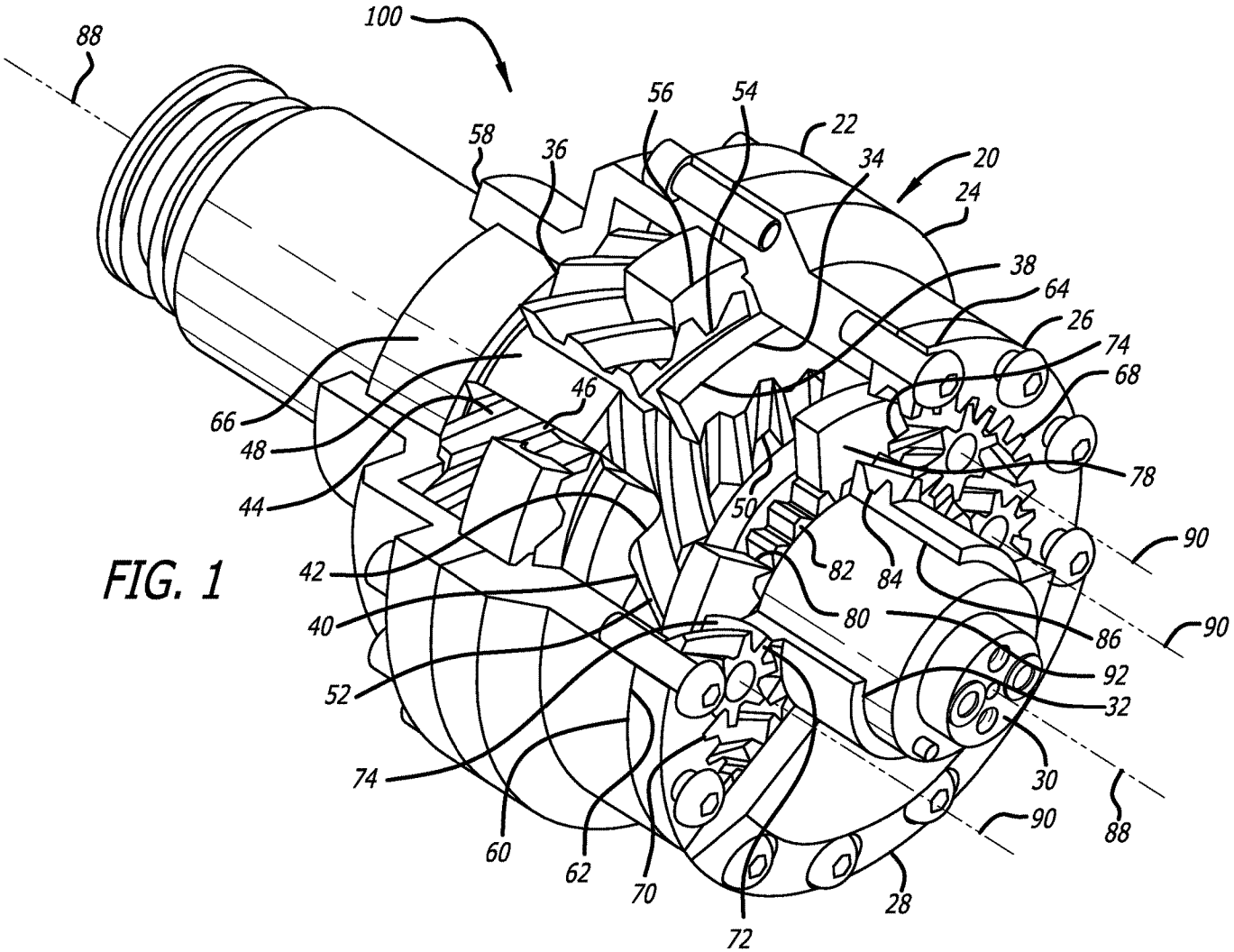
FIG. 1 is a partial cross-sectional perspective view of a hydraulic actuator according to one embodiment of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Broadly speaking, the present invention provides a hydraulic actuator that requires a relatively low power input in order to provide a relatively fast actuation speed. These objectives are achieved, in part, by employing a relatively short piston stroke distance and a novel secondary planet gear amplification.

Figure 3:
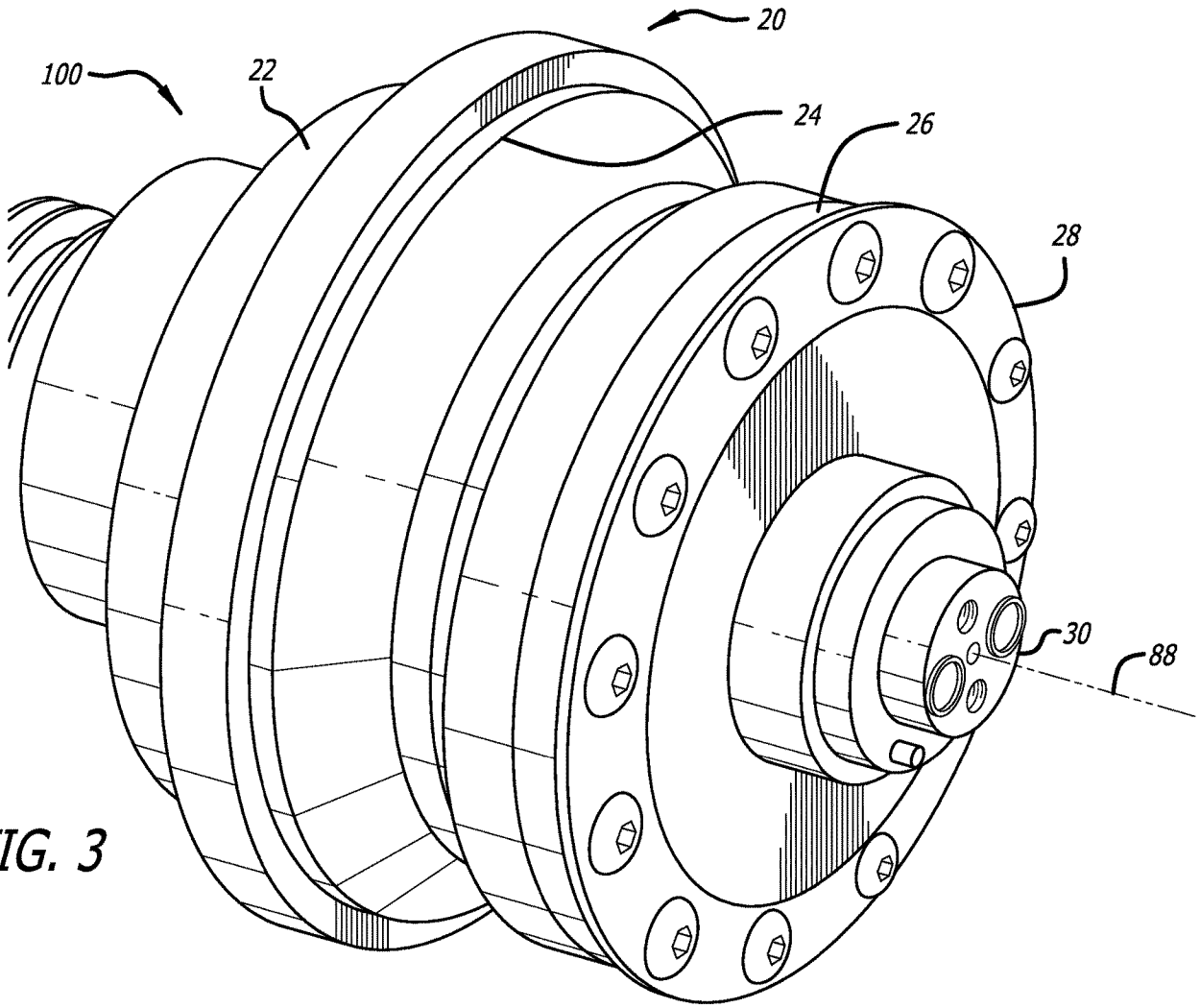
FIG. 3 is a perspective view of a hydraulic actuator according to one embodiment of the present invention.

According to one embodiment of the present invention, an actuator 100 is actuated by a hydraulic fluid. With reference to FIGS. 1 and 3, the hydraulic fluid is contained within the actuator 100, in part, by a hub 20 that is formed of a first portion 22 and a second portion 24, by a secondary ring gear 26, and by a cover 28. A first end 58 of the hub 20 is slidably engaged over a surface 66. A second end 60 of the hub 20 is attached, for example directly attached, to a side 62 of the secondary ring gear 26. The cover 28, in turn, is attached, for example directly attached, to an opposite side 64 of the secondary ring gear 26. O-rings or other means of sealing are employed or otherwise incorporated into and/or between the first portion 22, the second portion 24, the secondary ring 26, and the cover 28 and other components adjacent to these components in order to seal the hydraulic fluid within the actuator 100.

In operation, the actuator 100 has three possible rotational outputs: a primary shaft 30, a secondary shaft 32, and the hub 20. In certain embodiments, at least one of these outputs is fixed to a reference or anchoring structure. For example, at least one of the outputs is statically attached or mounted to a frame of a device in which the actuator 100 is employed. In certain alternative embodiments, neither of the primary shaft 30, the secondary shaft 32, and the hub 20 is statically fixed or anchored and one or more outputs is generated through a differential movement between two of more of the outputs i.e. through a differential work of at least two of the primary shaft 30, the secondary shaft 32, and the hub 20.

Solely for the purpose of explanation and without limiting the operation of the present invention, in the following description of the operation of the actuator 100, the primary shaft 30 is considered stationary or anchored relative to the other described components. For the sake of clarity, the various components of the actuator 100 will be described in the context of the operation of the actuator 100.

Figure 2:
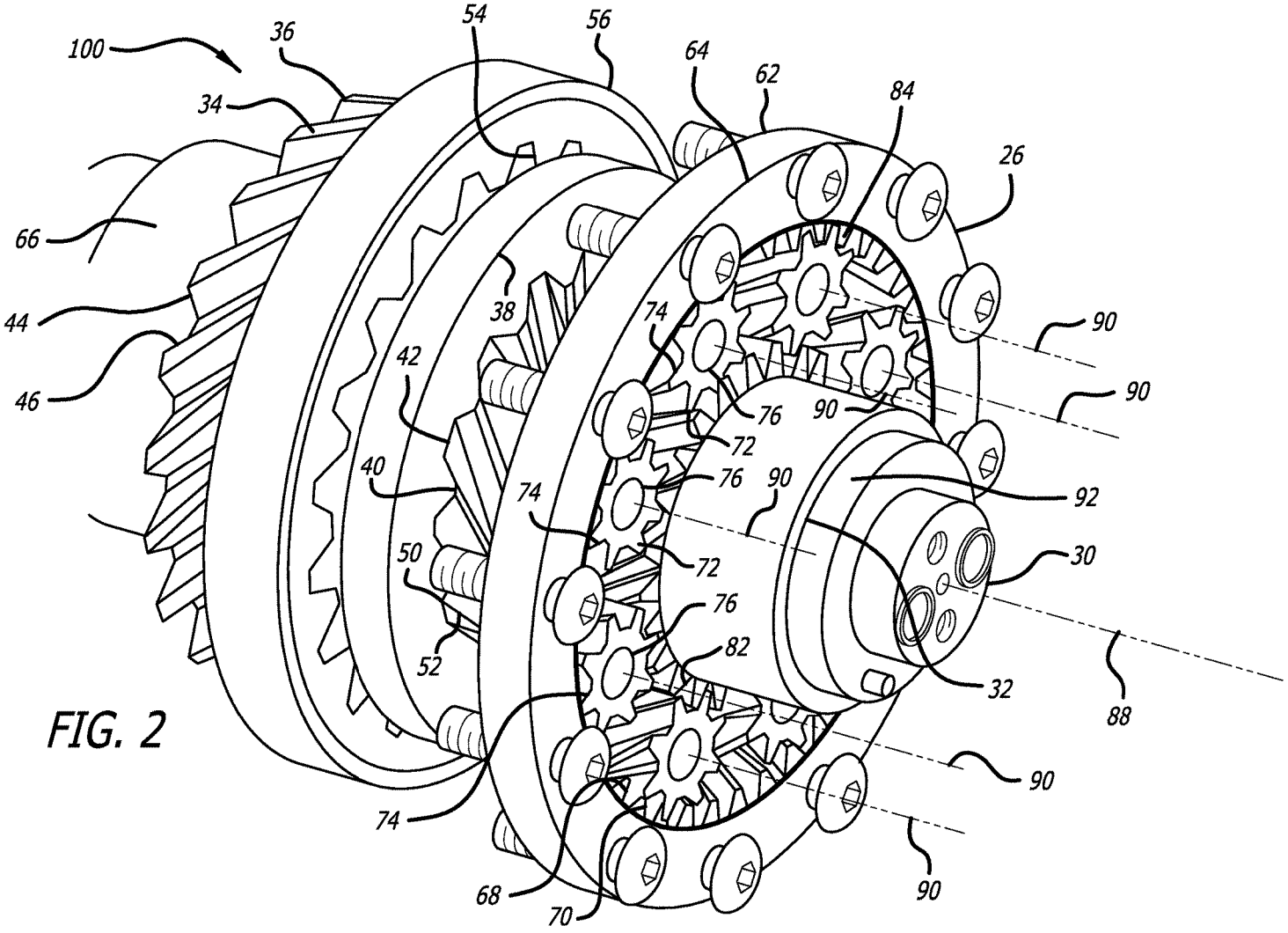
FIG. 2 is a perspective view of certain components of a hydraulic actuator according to one embodiment of the present invention.

The actuator 100 is actuated by pressurized fluid acting on a piston 34. With reference to FIGS. 1 and 2, the fluid acts alternatively upon a first end 36 and a second end 38 of the piston 34. The piston 34 has a generally cylindrical, tubular shape having an internal surface 42 and an external surface 46. Formed on a portion of the internal surface 42 of the piston 34, near the second end 38, are internal helical teeth 40. The internal helical teeth 40 are engaged, for example directly and rotatably engaged, with complementary helical teeth 50 of a gear 52. The gear 52 is positioned through an interior of the piston and is statically attached or otherwise fixed relative to the primary shaft 30. The shaft 30 defines a primary axis 88.

A portion of the internal surface 42 of the piston 34, near the first end 36 of the piston 34, is smooth, i.e. is not formed with teeth or other engaging structure, and is slidable over a surface 48. The surface 48 may, for example, be a surface that is statically attached or otherwise fixed relative to the primary shaft 30.

Formed on a portion of the external surface 46 of the piston 34, near the first end 36, are external helical teeth 44. The external helical teeth 44 of the piston 34 are engaged, for example directly and rotatably engaged, with the complementary helical teeth 54 of a primary annular or ring gear 56. The primary ring gear 56 is positioned around an exterior portion of the piston 34 and is statically attached to the hub 20. For example, the first portion 22 and the second portion 24 of the hub 20 may pinch or otherwise form a friction fit against opposing sides of the primary ring gear 56 at a point where the first portion 22 and the second portion 24 of the hub 20 are attached to one another.

The internal helical teeth 40 and external helical teeth 44 of the piston 34 are arranged on their respective surfaces in opposing directions. Alternatively stated, the internal helical teeth 40 and external helical teeth 44 of the piston 34 are formed at opposite helical angles relative to one another.

When fluid pressure is applied against, for example, the first end 36 of the piston 34, the piston 34 slides axially in a direction towards the cover 28. As the piston 34 slides over surface 48 and over the helical teeth 50 of the gear 52, the engagement of the interior helical teeth 40 of the piston 34 with the helical teeth 50 of the gear 52 causes the piston 34 to move or displace in an axial direction and in a circumferential rotational direction around the helical teeth 50 of the gear 52, which is considered stationary in the present description solely for the sake of clarity.

Due to the engagement of the external helical teeth 44 of the piston 34 with the helical teeth 54 of the primary ring gear 56, the rotation of the piston 34 about the gear 52 results in a compounded rate of rotation of the primary ring gear 56 and, hence, a compounded rate of rotation of the hub 20 to which the primary ring gear 56 is statically attached. Since the hub 20, the secondary ring gear 26 and the cover 28 are statically attached to one another, the rotation of the hub 20 is communicated to and results in a rotation of the secondary ring gear 26 and the cover 28.

An interior surface 68 of the secondary ring gear 26 forms helical teeth 70. The helical teeth 70 are engage, for example directly and rotatably engaged, with complementary helical teeth 72 of a plurality of planet gears 74. The helical teeth 72 of the plurality of planet gears 74 concurrently engage, for example directly and rotatably engage, with the complementary helical teeth 84 of the secondary shaft 32. The planet gears 74 rotate around planet gear shafts 76 that are statically attached to a surface 78 of carrier 80. Each of the planet gear shafts 76 define secondary axes 90 that are substantially parallel to the primary axis 88. The carrier 80 is fixed, for example directly fixed, to the primary shaft 30 through, for example, a spline 82 or other functionally similar configuration.

Through the interconnectivity of the piston 34, the primary ring gear 56, the hub 20, and the secondary ring gear 26, the plurality of planet gears 74 are in rotational communication with piston 34. Through the interconnectivity of the primary shaft 30, the carrier 80, and the planet gear shafts 76, the plurality of planet gears 74 are also in rotational communication with the primary shaft 30.

Hence, in the present example in which the primary shaft 30 and thereby the planet gear shafts 76 are maintained stationary, as the helical teeth 70 of the secondary ring gear 26 circumferentially rotate with the rotation of the piston 34, the primary ring gear 56, and the hub 20, the plurality of planet gears 74 rotate about the planet gear shafts 76. The rotation of the plurality of planet gears 74 is communicated to the helical teeth 84 of secondary shaft 32, thereby resulting in a rotation of the secondary shaft 32.

In certain embodiments, the secondary shaft 32 has a generally cylindrical, tubular shape. An interior surface 86 of the secondary shaft 32 is coaxially and slidably mounted over or around a portion of an exterior surface 92 of the primary shaft 30. Accordingly, the primary shaft 30 and the secondary shaft 32 are operable to circumferentially rotate independent of one another.

Hence, in the present example of the actuator 100 in which the primary shaft 30 of the actuator 100 is considered as stationary, when fluid pressure is applied against the first end 36 of the piston 34, an output or motion results in both of the secondary shaft 32 and the hub 20. One having skill in the art will recognize that alternative embodiments exist in which either the secondary shaft 32 or the hub 20 are alternatively stationary or in which none of the outputs are maintained stationary.

In certain embodiments, the actuator on the present invention is employed in a robot. In certain other embodiments, the actuator of the present invention is employed in industrial automation equipment, hydraulic machinery, construction equipment and other applications that employ or have use for actuation.

The actuator according to the present invention advantageously provides for significantly more rotational travel than a known helical actuator of similar size or dimension. Accordingly, the actuator of the present invention allows for weight and space savings over known helical actuators. Furthermore, known helical actuators have relatively low rotational speeds due to the actuator design being prone to relatively high friction. In contrast, the actuator of the present invention has reduced friction and thus has increased rotational speed through, in part, employing the novel secondary planet gear amplification stage and a smaller piston stroke distance relative to known helical actuators.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A hydraulic actuator comprising:

a primary shaft having a cylindrical gear positioned within an interior of a tubular piston and in direct rotatable engagement with the piston;

an outer annular gear positioned around a portion of an exterior of the piston and in direct rotatable engagement with the piston;

an inner tubular gear distinct from the primary shaft and the piston and independently rotatable around a portion of the primary shaft; and a plurality of planet gears in rotational communication with the piston through the outer annular ring and through the primary shaft and in direct rotatable engagement with the inner tubular gear.

2. The hydraulic actuator of claim 1 wherein a helical gear is formed on an exterior surface of the primary shaft that engages with a helical gear formed on an interior surface of the piston.

3. The hydraulic actuator of claim 1 wherein a helical gear is formed on an interior surface of the outer annular gear that engages with a helical gear formed on an exterior surface of the piston.

4. The hydraulic actuator of claim 1 wherein the outer annular gear is statically attached to a hub.

5. The hydraulic actuator of claim 1 wherein a helical gear is formed on an exterior surface of each planet gear of the plurality of planet gears that engages with a helical gear formed on the inner tubular gear.

6. The hydraulic actuator of claim 1 further comprising a hub statically attached to the outer annular gear and to a secondary annular ring gear that is in direct engagement with the plurality of planet gears.

7. The hydraulic actuator of claim 1 wherein the piston is transposable in an axial direction and in a circumferential rotational direction relative to the primary shaft and the outer annular gear.

8. A hydraulic actuator comprising:

a hub through which a tubular piston is positioned;

a primary shaft positioned through an interior of the tubular piston;

a secondary shaft independent of the primary shaft and the tubular piston and positioned over and rotatable around a portion of the primary shaft; and a plurality of planet gears positioned around a portion of an exterior of the secondary shaft.

9. The hydraulic actuator of claim 8 wherein the hub is attached to an annular ring having an interior surface that forms a helical gear that is engaged with a helical gear formed on an exterior of the piston.

10. The hydraulic actuator of claim 8 wherein an interior surface of the piston forms a helical gear that is engaged with a helical gear formed on an exterior of the primary shaft.

11. The hydraulic actuator of claim 8 wherein an exterior surface of each planet gear of the plurality of planet gears forms a helical gear that is engaged with a helical gear formed on an exterior of the secondary shaft.

12. The hydraulic actuator of claim 8 wherein the hub is attached to an annular ring having an interior surface that forms a helical gear that is engaged with a helical gear formed on an exterior of each planet gear of the plurality of planet gears.

13. The hydraulic actuator of claim 8 wherein the secondary shaft is slidably positioned over a portion of an exterior of the primary shaft.

14. A method for hydraulic actuation comprising:

displacing a tubular piston axially along a primary axis and circumferentially around the primary axis;

rotating each planet gear of a plurality of planet gears around one of a plurality of secondary axes that are substantially parallel to the primary axis based upon said displacing; and providing two different rotational outputs having different rates of rotation based upon said rotating.

15. The method of claim 14 wherein displacing the tubular piston axially along the primary axis and circumferentially around the primary axis comprises displacing the tubular piston over a cylindrical helical gear.

16. The method of claim 14 wherein rotating each planet gear of the plurality of planet gears around one of the plurality of secondary axes that are substantially parallel to the primary axis based upon said displacing comprises displacing the tubular piston through an annular helical gear.

17. The method of claim 14 wherein rotating each planet gear of the plurality of planet gears around one of the plurality of secondary axes that are substantially parallel to the primary axis based upon said displacing comprises rotating a hub around the tubular piston.

18. The method of claim 14 wherein rotating each planet gear of the plurality of planet gears around one of the plurality of secondary axes that are substantially parallel to the primary axis based upon said displacing comprises rotating a primary shaft positioned through the tubular piston.

19. The method of claim 14 wherein providing the two different rotational outputs having different rates of rotation based upon said rotating comprises rotating an annular helical gear positioned within said plurality of planet gears.

20. The method of claim 14 further comprising a third rotational output having a rotational output different from the rotational outputs of the two different rotational outputs.

* * * * *